United States Patent [19]

Roy et al.

[11] Patent Number: 4,658,267

[45] Date of Patent: Apr. 14, 1987

[54] RIDGED WAVEGUIDE ANTENNA WITH PLURAL FEED INPUTS

[75] Inventors: Albert A. Roy, Lompoc; George J. Monser, Goleta, both of Calif.

[73] Assignee: Raytheon Company, Lexington, Mass.

[21] Appl. No.: 666,796

[22] Filed: Oct. 31, 1984

[51] Int. Cl.[4] ..... H01Q 13/02

[52] U.S. Cl. ..... 343/786; 343/772

[58] Field of Search ..... 343/786, 772, 778, 776; 333/239, 248

[56] References Cited

U.S. PATENT DOCUMENTS

| | | | |
|---|---|---|---|
| 2,825,060 | 2/1958 | Ruze | 343/786 |
| 3,100,894 | 8/1963 | Giller et al. | 343/786 |
| 3,389,394 | 6/1968 | Lewis | 343/786 |
| 3,458,862 | 7/1969 | Franks | 343/786 |
| 4,353,074 | 10/1982 | Monser et al. | 343/786 |

FOREIGN PATENT DOCUMENTS

| | | | |
|---|---|---|---|
| 1125682 | 11/1984 | U.S.S.R. | 343/786 |

*Primary Examiner*—Eli Lieberman
*Assistant Examiner*—Michael C. Wimer
*Attorney, Agent, or Firm*—Richard M. Sharkansky; Denis G. Maloney; Peter J. Devlin

[57] ABSTRACT

A radio frequency antenna element is provided comprising a waveguide having disposed within and adjacent to a rearward portion of such waveguide a ridge, such ridge having a relatively narrow forward portion and a plurality of feeds, disposed within the waveguide, for coupling energy from a plurality of sources to a relatively wider, rearward portion of the ridge. The waveguide has a pair of opposing, relatively wide upper and lower walls and a pair of opposing, relatively narrow side walls. The relatively wider, rearward portion of the ridge tapers to the narrower forward portion of the ridge in a plane parallel to the upper and lower walls of the waveguide. The narrow portion of the ridge tapers towards one of the wider walls as such ridge extends from the rearward portion of the waveguide to the forward portion of the waveguide. With such arrangement, energy from a plurality of sources may be fed to the antenna element and such energy thereby combined within the antenna element itself rather than being combined externally of the antenna element. More particularly, energy fed to the plurality of feeds at the relatively wide rearward portion of the ridge combines as the energy passes from the relatively wide rearward portion of the ridge to the relatively narrow forward portion of such ridge.

7 Claims, 7 Drawing Figures

RIDGED WAVEGUIDE ANTENNA WITH PLURAL FEED INPUTS

BACKGROUND OF THE INVENTION

This invention relates to radio frequency antenna, and more particularly, to radio frequency antenna adapted to operate with relatively high amounts of power.

As is known in the art, many installations for array antennas impose physical constraints on the size of such an antenna. For example, in an airborne installation, each one of the antenna elements in the array thereof should have minimum depth, width and thickness. Further, in many applications, it is necessary that the antenna operate over a relatively wide bandwidth and handle relatively high amounts of power during transmission of radio frequency energy. One antenna element which has the appropriate size and bandwidth is described in our U.S. Pat. No. 4,353,074 issued Oct. 5, 1982 entitled "Radio Frequency Ridged Waveguide Antenna", assigned to the same assignee as the present invention. As described therein, an open-ended waveguide includes a tapered ridge disposed within the rearward section of the waveguide. The ridge is coupled to a coaxial transmission line for feeding energy into the waveguide. While such an antenna element is adapted to handle large amounts of power and operate over a relatively wide bandwidth, the antenna element has only a single power input and thus the power available for flow into the ridge waveguide antenna, and ultimately transmitted into free-space, is limited to that available from a single source; typically, the output of a travelling wave tube (TWT) amplifier. In those applications requiring feeding more power into each antenna element of an existing array, an external-to-the antenna element power combiner (or hybrid coupler) is used. Thus, the outputs of the plurality of TWT's are fed to the corresponding plurality of power combiner inputs, and the output of the power combiner is then coupled to the antenna element. However, losses occur in the combiner and additional space is required to accommodate such an external-to-the antenna element combiner.

SUMMARY OF THE INVENTION

In accordance with the present invention, a radio frequency antenna element is provided comprising: a waveguide having disposed within and adjacent to a rearward portion of such waveguide a ridge, such ridge having a relatively narrow forward portion and a plurality of feeds, disposed within the waveguide, for coupling energy from a plurality of sources to a relatively wider, rearward portion of the ridge.

In a preferred embodiment of the invention, the waveguide has a pair of opposing, relatively wide upper and lower walls and a pair of opposing, relatively narrow side walls. The relatively wider, rearward portion of the ridge tapers to the narrower forward portion of the ridge in a plane parallel to the upper and lower walls of the waveguide. The narrow portion of the ridge tapers towards one of the wider walls as such ridge extends from the rearward portion of the waveguide to the forward portion of the waveguide.

With such arrangement, energy from a plurality of sources may be fed to the antenna element and such energy thereby combined within the antenna element itself rather than being combined externally of the antenna element. More particularly, energy fed to the plurality of feeds at the relatively wide rearward portion of the ridge combines as the energy passes from the relatively wide rearward portion of the ridge to the relatively narrow forward portion of such ridge.

BRIEF DESCRIPTION OF THE DRAWINGS

The foregoing features of this invention, as well as the invention itself, may be more fully understood from the following description read together with the accompanying drawings, in which.

DESCRIPTION OF THE PREFERRED EMBODIMENTS

Figure 1:
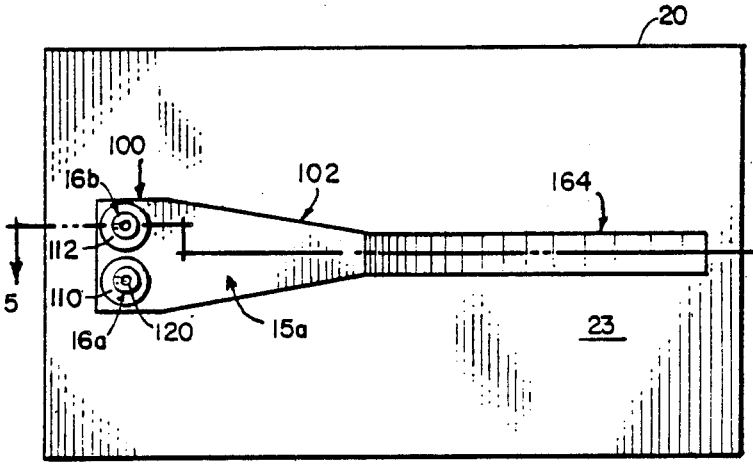
FIG. 1 is a plan view of a first one of a pair of members which, when affixed to a second one of the pair of members provides a radio frequency antenna according to the invention.
Figure 2:
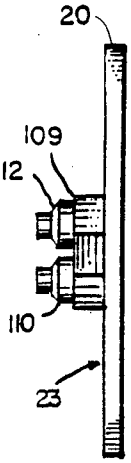
FIG. 2 is an end view of the first one of the pair of members shown in FIG. 1.

Referring now to FIGS. 1–6, a radio frequency antenna element 10 is shown to include a rectangular open-ended waveguide 12 having disposed therein a pair of ridges 15*a*, 15*b*. The ridges 15*a*, 15*b* are provided with a plurality of, here two, feeds 16*a*, 16*b* for coupling energy from two energy sources (not shown) into the waveguide 12, the energy from the two sources being combined within the waveguide 12 for transmission by the antenna element 10.

Here antenna element 10 includes an upper conductive member 20 and a lower conductive member 22. When fastened together by any conventional means, not shown, the bottom surface 23 of the upper member 20 provides the upper relatively wide wall of the waveguide 12 (i.e., an H-plane wall). The upper member 20, here a block of aluminum, also has formed on the bottom thereof a ridge 15*a* to be described in detail hereinafter. The lower member 22 is here also a block of aluminum having machined into the upper surface 30 thereof S-shaped opposing, relatively narrow sidewalls 32 and a rear wall 34 having a recessed notch formed therein. When fastened together, peripheral portions of the bottom surface 23 of the upper member 20 rest on the peripheral portions of upper surface 30 of the lower member 22 to thereby form a waveguide having a rectangular cross-section. The inner portions of the bottom surface 36 of the lower member 22 (i.e., those portions bounded by the S-shaped sidewalls 32 and back wall 34) provide the lower, relatively wide wall of the waveguide 12. The side walls 32 and wide walls 23, 36 are dimensioned to support the $TE_{10}$ mode of propagation; the E-plane being perpendicular to the plane of the wide walls 23, 36 (i.e., the narrow side walls 32 thus being disposed in the E-plane); the electric field extending between the wide walls of the waveguide 12 as shown by the arrow E in FIG. 5. Affixed to the lower conductive member 22 is a ridge **15*b* to be described in detail hereinafter. It is noted that the separation between the side walls 32 is relatively constant in the middle region of the waveguide 12; however, such separation decreases, here along curved paths, as such side walls extend to the rear wall 34. As discussed in our U.S. Pat. No. 4,353,074, converging the side walls 32 as they extend to the rear wall 34 improves the impedance matching from the feed to the antenna element 10. The portions of the side walls 32 disposed between the middle of the waveguide and the front end 39 (FIG. 5) of the antenna element 12 are flared outwardly along a non-linear path to increase the surface length of the side walls 32**, as described in our U.S. Pat. No. 4,353,074.

Referring now to the ridges **15*a*, 15*b*, and first to the ridge 15*b* affixed in the lower conductive member 22, it is noted that such ridge 15*b* has three integrally formed sections: a rearward section 40 having a width, here approximately 0.64λ (where λ is the nominal operating wavelength of the antenna), an upper, flat surface 42 disposed in the H-plane and elevated from the lower, relatively wide wall 36 at the bottom of the waveguide 12 a predetermined height and having a constant width sufficient to accommodate the pair of cavities 48, 50, drilled into the flat rearward section 42 of the ridge 15*b* to form a part of the pair of feeds for the antenna element 10; an intermediate section 45 having a length, here 0.92λ, with flat upper surface 60 disposed in a common plane with the flat surface 42 of the rearward section 42 of the ridge 15*b*, but having a width tapering, here linearly, from the wider width of the rearward section 40 of the ridge 15*b* to a narrow width (here 0.2λ); and, a forward section 62 having the same width as the narrower width of the intermediate section 45 but tapering downward in elevation towards the lower, relatively wide wall 36 of the waveguide 12 to a lower predetermined elevation from such wall 36 as the frontal portion of the ridge 15*b* extends forward, towards the front 39 of the antenna element 10 with constant width, symmetrically along the longitudinal axes 68 of the antenna element 10. As mentioned briefly above, two circular cavities 48, 50 are drilled into the flat surface 42 of the rearward section 40 of the ridge 15*b*, such cavities 48, 50 being drilled along a pair of parallel axes in the E-plane and disposed symmetrically about the longitudinal axis 68. Drilled orthogonally to the pair of axes are a pair of smaller diameter holes 70, 72 which pass from the rear, outer wall 74 of the lower member 22 into the cavities 48, 50, as shown, for receiving center conductors 90, 92 of a pair of coaxial connectors to be described in detail hereinafter. It is further noted that the rear most portion of the ridge 15*b* is disposed within the notch formed in the rear wall 34 and it should also be noted that the flat surfaces 42, 60 of the rearward and intermediate sections 40, 45 of the ridge 15*b* are below the upper surface 30 of the lower conductive member 22**.

Figure 5:
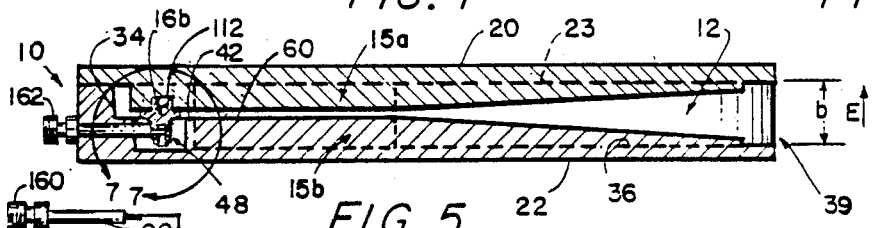
FIG. 5 is a cross-sectional view of the radio frequency antenna showing the first member of FIG. 1 and the second member of FIG. 2 affixed together to form such antenna, the cross-section of the first and second members being taken along line 5—5 in FIGS. 1 and 3.
Figure 3:
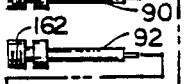
FIG. 3 is a plan view of the second one of the pair of members, which when affixed to the first one of the pair of members provides a radio frequency antenna.
Figure 3:
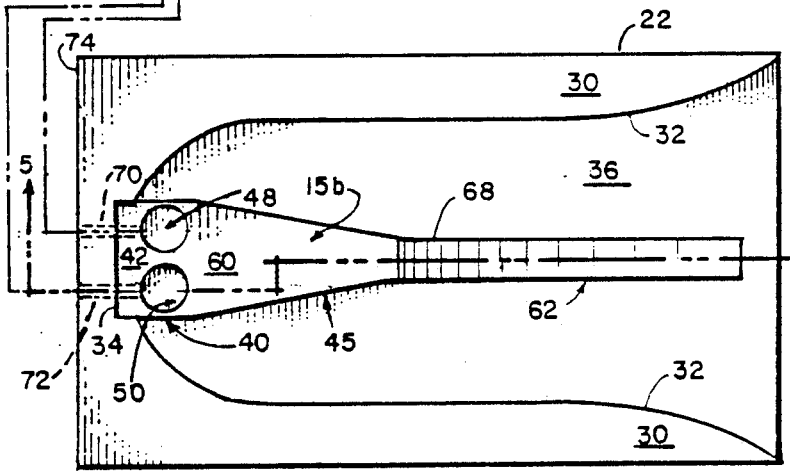
Figure 4:
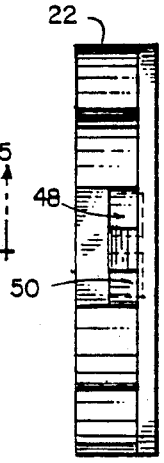
FIG. 4 is an end view of the second one of the pair of members shown in FIG. 3.
Figure 6:
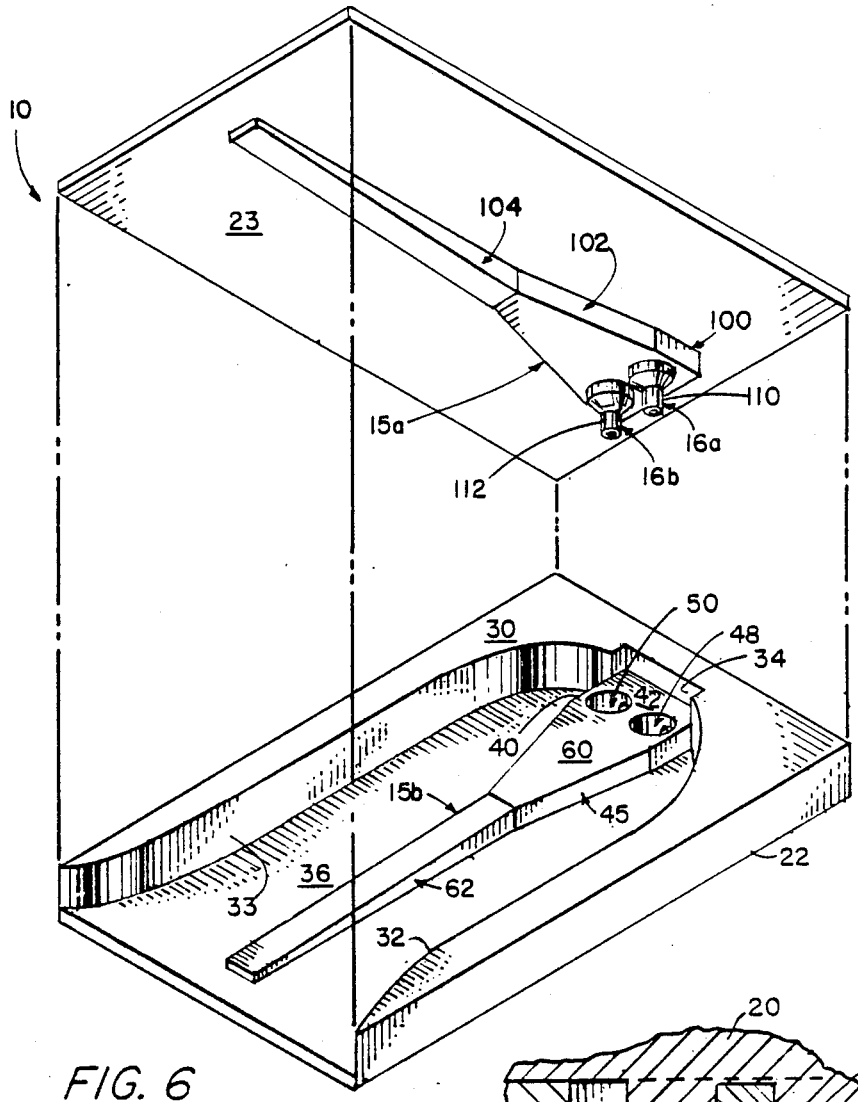
FIG. 6 is an exploded, isometric view of the pair of members shown in FIGS. 1 and 3, such pair of members, when affixed to each other, forming the radio frequency antenna.
Figure 7:
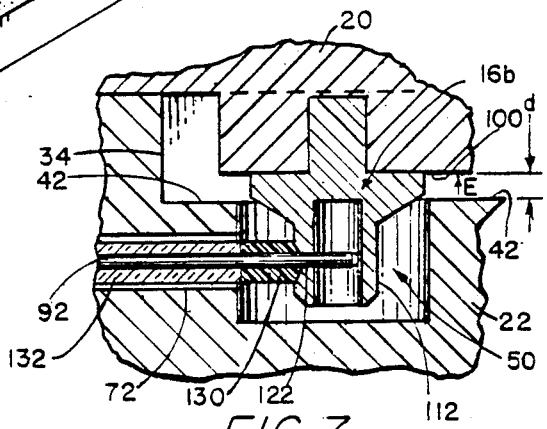
FIG. 7 is a cross-sectional elevation view showing a portion of the feed probe and a portion of the pair of members, such FIG. 7 being of the region 7—7 of FIG. 5.

Considering next the ridge **15*a* formed in the upper conductive member 20, it is noted that such ridge 15*a* also has three integrally formed sections 100, 102, 104 which mirror the three integrally formed sections 40, 45, 62 formed in the lower conductive member 22 described above. Here, however, the flat, rearward section 100 of the ridge 15*a* formed in the upper member 20 is provided with a pair of turret shaped posts 110, 112, such posts providing the pair of feeds 16*a*, 16*b*. Each one of the pair of posts 110, 112 is identical in construction, an exemplary one thereof, here post 112 is shown in detail in FIG. 7. The posts 110, 112 are press fit into the ridge 15*a* by a pin shaped end. The posts 110, 112 each have a hole 120, 122 drilled therein, as shown, for receiving the center conductors 90, 92 of a coaxial connector in a manner to be described in detail in connection with FIG. 7. It is noted from FIGS. 5 and 7, when assembled, the posts 110, 112 fit into the cavities 48, 50, respectively, as shown in FIGS. 6 and 7**.

As noted above, when the upper and lower members 20, 22 are affixed together, a hollow waveguide 12 having a rectangular cross-section dimensioned to support the $TE_{10}$ mode of propagation is formed having a pair of tapered ridges **15*a*, 15*b* and each fed from a pair of feeds 16*a*, 16*b*. Further, when affixed, the rearward flat portion of the ridges 15*a*, 15*b* are separated by a distance d (FIG. 7) and the wide walls of the waveguide are separated a distance b (FIG. 5). The tapered ridges 15*a*, 15*b* are fed by coaxial conductors having center conductors 90, 92 passing through holes 70, 72 and the end of such conductors 90, 92 are press fit into the posts 100, 112 to provide electrical and mechanical contact to the posts. The outer conductor of the coaxial connector is electrically and mechanically connected to the affixed members 20, 22 by any conventional means, not shown. Each of the inner conductors 90, 92 is separated from the periphery of the holes 70, 72 by dielectric sleeve 130, as shown in FIG. 7. A ferrite ring 132 is disposed around the inner conductor 92 between the dielectric 130 and the post, as shown in FIG. 7 to provide impedance matching between the coaxial connector and the post. Radio frequency energy fed to the antenna element 10 via connectors 160, 162 (FIG. 3.) thus travels toward the front or open end 39 (FIG. 5) of the waveguide 12 in the $TE_{10}$ mode having an electric field vector between the flat rearward sections 40, 100 of the opposing ridges 15*a*, 15*b*. The field from the feeds converge towards the narrower end of the intermediate sections 45, 102 as it propagates from the rearward sections, 40, 100. Thus, the energy fed from separate sources to the antenna element 10 combine within the antenna element 10, and the combined energy is then radiated by the antenna element 10** into free space.

Having described a preferred embodiment of the invention, it is now evident that other embodiments incorporating these concepts may be used. It is felt, therefore, that the invention should not be restricted to the disclosed embodiment but rather should be limited only by the spirit and scope of the appended claims.

What is claimed is:

1. A radio frequency antenna element comprising:

(a) a waveguide comprising a ridge member disposed within a rearward portion of the waveguide; and (b) a plurality of feed means, disposed within the rearward portion of the waveguide, for coupling energy from a corresponding plurality of sources to the ridge member, the waveguide, ridge member and plurality of feed means being arranged to combine the energy from each one of said sources within the waveguide, such combined energy radiating from a forward portion of the waveguide into free space.

2. A radio frequency antenna comprising:

(a) a waveguide;

(b) a ridge disposed within and adjacent to a rearward portion of the waveguide, such ridge having a relatively narrow forward portion and a relatively wider rearward portion; and (c) a plurality of feed means, disposed within the waveguide adjacent the rearward portion of the ridge for coupling energy from a plurality of sources to the wider rearward portion of the ridge, such energy passing from the rearward portion to the forward portion of the waveguide, the waveguide, ridge and plurality of feed means being arranged to combine such energy from the plurality of sources within the waveguide as such energy passes from the rearward portion of the waveguide to the forward portion of the waveguide.

3. The radio frequency antenna recited in claim 2 wherein the waveguide has a pair of opposing relatively wide upper and lower walls and a pair of opposing relatively narrow side walls, and wherein the relatively wider rearward portion of the ridge tapers in width to the narrower forward portion of the ridge in a plane parallel to the upper and lower walls of the waveguide and wherein the narrow portion of the ridge tapers in elevation towards one of the wider walls as such ridge extends from the rearward portion of the waveguide to the forward portion of the waveguide.

4. The radio frequency antenna recited in claim 3 wherein each one of the plurality of feed means includes a post disposed perpendicular to the wide upper and lower walls.

5. The antenna recited in claim 4 wherein the waveguide is elongated along a longitudinal axis and wherein the plurality of posts are disposed symetrically with respect to the longitudinal axis of the waveguide.

6. A radio frequency antenna element comprising:

(a) a waveguide;

(b) a ridge member disposed within a rearward portion of the waveguide; and (c) a plurality of feed means, disposed adjacent one another on the ridge member, for coupling energy from a corresponding plurality of sources to the waveguide, the coupled energy from each one of the plurality of sources having substantially the same electric field direction in the waveguide and combining within the waveguide as such coupled energy passes from the rearward portion of the waveguide to a forward portion of the waveguide.

7. The radio frequency antenna of claim 6 wherein the waveguide comprises a pair of opposing relatively wide upper and lower walls and a pair of opposing relatively narrow side walls, and wherein said electric field direction is substantially perpendicular to the pair of opposing relatively wide upper and lower walls.

* * * * *